US008228144B2

(12) United States Patent
Sugisawa et al.

(10) Patent No.: US 8,228,144 B2
(45) Date of Patent: Jul. 24, 2012

(54) ELECTROMAGNETIC RELAY

(75) Inventors: Masanao Sugisawa, Hekinan (JP); Shigeki Fujii, Kariya (JP); Hitoshi Sunohara, Chita-gun (JP)

(73) Assignee: Anden Co., Ltd., Anjo (JP)

( * ) Notice: Subject to any disclaimer, the term of this patent is extended or adjusted under 35 U.S.C. 154(b) by 0 days.

(21) Appl. No.: 13/070,563

(22) Filed: Mar. 24, 2011

(65) Prior Publication Data

US 2011/0241809 A1 Oct. 6, 2011

(30) Foreign Application Priority Data

Mar. 30, 2010 (JP) ..... 2010-078217
Jul. 22, 2010 (JP) ..... 2010-165098

(51) Int. Cl.
*H01H 51/22* (2006.01)

(52) U.S. Cl. ..... 335/78; 335/128

(58) Field of Classification Search ..... 335/78–86, 335/124, 128, 131, 201
See application file for complete search history.

(56) References Cited

U.S. PATENT DOCUMENTS 4,404,443 A * 9/1983 Coynel et al. ..... 218/23
4,513,270 A 4/1985 Belbel et al.
5,546,061 A 8/1996 Okabayashi et al.
6,700,466 B1 * 3/2004 Yamamoto et al. ..... 335/201
7,145,422 B2 * 12/2006 Imanishi et al. ..... 335/201
7,782,162 B2 * 8/2010 Nishida ..... 335/201
7,911,301 B2 * 3/2011 Yano et al. ..... 335/78

FOREIGN PATENT DOCUMENTS

| | | |
|---|---|---|
| GB | 816636 | 7/1959 |
| JP | U-54-059154 | 4/1979 |
| JP | A-2007-214034 | 8/2007 |
| JP | A-2008-084807 | 4/2008 |
| JP | A-2008-226547 | 9/2008 |

OTHER PUBLICATIONS

European Search Report mailed Aug. 16, 2011 in corresponding European application No. 11002370.2.

* cited by examiner

*Primary Examiner* — Bernard Rojas
(74) *Attorney, Agent, or Firm* — Posz Law Group, PLC

(57) ABSTRACT

In an electromagnetic relay, length from a movable contact to an end portion of a movable element on a first end side is set greater than length from the movable contact to another end portion of the movable element on a second end side opposite to the first end side. A direction of a Lorentz force acting on a portion of the movable element from the movable contact to the end portion of the movable element on the first end side is conformed to a direction for bringing fixed contacts and movable contacts into contact with each other. Thus, separation between the movable contacts and the fixed contacts due to an electromagnetic repulsive force can be inhibited.

3 Claims, 11 Drawing Sheets

ELECTROMAGNETIC RELAY

CROSS REFERENCE TO RELATED APPLICATION

This application is based on and incorporates herein by reference Japanese Patent Applications No. 2010-78217 filed on Mar. 30, 2010 and No. 2010-165098 filed on Jul. 22, 2010.

BACKGROUND OF SHE INVENTION

1. Field of the Invention

The present invention relates to an electromagnetic relay for opening and closing an electrical circuit.

2. Description of Related Art

In a conventional electromagnetic relay, fixed contact retainers having fixed contacts are positioned and a single movable element having movable contacts is moved. Thus, an electrical circuit is closed by bringing the movable contacts and the fixed contacts into contact with each other. The electrical circuit is opened by separating the movable contacts and the fixed contacts from each other. More specifically, the conventional electromagnetic relay has a movable member attracted by an electromagnetic force of a coil, a contact pressure spring for biasing the movable element in a direction for bringing the fixed contacts and the movable contacts into contact with each other, a return spring for biasing the movable element via the movable member in a direction for separating the fixed contacts and the movable contacts from each other and the like.

If the coil is energized, the movable member is driven in a direction for separating from the movable element by the electromagnetic force. The movable element is biased by the contact pressure spring to move so that the fixed contacts contact the movable contacts. Then, the movable member separates from the movable element. For example, details of such the construction are described in Patent document 1 (Gazette of Japanese Patent No. 3321963), Patent document 2 (JP-A-2007-214034) or Patent document 3 (JP-A-2008-226547).

In the conventional electromagnetic relay, an electromagnetic repulsive force arises between contact portions of the movable contacts and the fixed contacts because currents flow in opposite directions in portions where the movable contacts face the fixed contacts. The electromagnetic repulsive force acts to separate the movable contacts and the fixed contacts from each other. Therefore, an elastic force of the contact pressure spring is set to prevent the separation between the movable contacts and the fixed contacts due to the electromagnetic repulsive force.

However, the electromagnetic repulsive force increases as the flowing current increases. Therefore, the elastic force of the contact pressure spring has to be increased in accordance with the increase in the current value. As a result, a body size of the contact pressure spring enlarges, so a body size of the electromagnetic relay enlarges.

SUMMARY OF THE INVENTION

It is an object of the present invention to provide an electromagnetic relay that inhibits separation between movable contacts and fixed contacts due to an electromagnetic repulsive force without increasing a necessary elastic force of a contact pressure spring.

According to a first example aspect of the present invention, an electromagnetic relay has a coil for generating an electromagnetic force when energized, a movable member capable of being attracted by the electromagnetic force of the coil, two fixed contact retainers having fixed contacts, a plate-like movable element having a plurality of movable contacts capable of contacting the fixed contacts and separating from the fixed contacts, a contact pressure spring for biasing the movable element in a direction for bringing the fixed contacts and the movable contacts into contact with each other, and a magnet arranged near a specific movable contact among the plurality of the movable contacts to be lateral to an outer periphery of the movable element.

When the movable member is attracted by the electromagnetic force of the coil, the movable member moves in a direction for separating from the movable element and the fixed contacts contact the movable contacts because the contact pressure spring biases the movable element.

A direction, which is perpendicular to both of a line connecting a north pole and a south pole of the magnet and a movement direction of the movable element, is defined as a reference direction.

Length of the movable element measured along a line, which passes through the specific movable contact in the reference direction, is divided into movable element first end side length and movable element second end side length. The movable element first end side length extends from the specific movable contact to an end portion of the movable element on a first end side with respect to the reference direction. The movable element second end side length extends from the specific movable contact to another end portion of the movable element on a second end side with respect to the reference direction opposite to the first end side.

In this case, the movable element first end side length is greater than the movable element second end side length. A Lorentz force acting on a portion of the movable element extending from the specific movable contact to the end portion of the movable element on the first end side is directed in a direction for bringing the fixed contacts and the movable contacts into contact with each other.

A Lorentz force (referred to as former Lorentz force) acting on the portion of the movable element extending from the specific movable contact to the end portion of the movable element on the first end side is directed in the direction for bringing the fixed contacts and the movable contacts into contact with each other. A Lorentz force (referred to as latter Lorentz force) acting on a portion of the movable element extending from the specific movable contact to the end portion of the movable element on the second end side is directed in a direction for separating the fixed contacts and the movable contacts from each other.

The movable element first end side length is set greater than the movable element second end side length. Therefore, a direction of current flowing between the specific movable contact of the movable element and the end portion of the movable element on the first end side tends to become parallel to the reference direction. A direction of current flowing between the specific movable contact of the movable element and the end portion of the movable element on the second end side tends to be inclined with respect to the reference direction.

Therefore, the former Lorentz force is larger than the latter Lorentz force. A resultant Lorentz force as the sum of the both Lorentz forces is a force in a direction for bringing the fixed contacts and the movable contacts into contact with each other. The resultant Lorentz force opposes the electromagnetic repulsive force. Therefore, separation between the movable contacts and the fixed contacts due to the electromagnetic repulsive force can be inhibited.

According to a second example aspect of the present invention, in the electromagnetic relay of the first example aspect, the movable element has a notch, which is formed between the specific movable contact and the other movable contact to be lateral to the specific movable contact. The notch extends in the reference direction from the end portion of the movable element on the second end side.

With such the construction, the direction of the current flowing between the specific movable contact of the movable element and the end portion of the movable element on the first end side is more apt to become parallel to the reference direction. Accordingly, the Lorentz force in the direction for bringing the fixed contacts and the movable contacts into contact with each other increases more. Thus, the separation between the movable contacts and the fixed contacts due to the electromagnetic repulsive force can be inhibited more.

According to a third example aspect of the present invention, an electromagnetic relay has a coil for generating an electromagnetic force when energized, a movable member capable of being attracted by the electromagnetic force of the coil, two fixed contact retainers having fixed contacts, a plate-like movable element having a first movable contact and a second movable contact capable of contacting the fixed contacts and separating from the fixed contacts, a contact pressure spring for biasing the movable element in a direction for bringing the fixed contacts and the first and second movable contacts into contact with each other, a first magnet arranged near the first movable contact to be lateral to an outer periphery of the movable element, and a second magnet arranged near the second movable contact to be lateral to the outer periphery of the movable element.

When the movable member is attracted by the electromagnetic force of the coil, the movable member moves in a direction for separating from the movable element and the fixed contacts contact the first movable contact and the second movable contact because the contact pressure spring biases the movable element.

The first magnet and the second magnet are arranged such that a line connecting a north pole and a south pole of the first magnet is parallel to a line connecting a north pole and a south pole of the second magnet and such that the first magnet and the second magnet are spaced from each other in a direction of the line connecting the north pole and the south pole of the first magnet.

The first movable contact and the second movable contact are arranged between the first magnet and the second magnet and spaced from each other in the direction of the line connecting the north pole and the south pole of the first magnet.

A direction, which is perpendicular to both of the line connecting the north pole and the south pole of the first magnet and a movement direction of the movable element, is defined as a reference direction.

A part of length of the movable element, which is measured along a line passing through the first movable contact in the reference direction, on a first side of the first movable contact is differentiated from another part of the length of the movable element, which is measured along the line passing through the first movable contact in the reference direction, on a second side of the first movable contact opposite to the first side. Thus, a resultant force of Lorentz forces acting on the movable element near the first movable contact is directed in a direction for bringing the fixed contact and the first movable contact into contact with each other.

A part of length of the movable element, which is measured along a line passing through the second movable contact in the reference direction, on a first side of the second movable contact is differentiated from another part of the length of the movable element, which is measured along the line passing through the second movable contact in the reference direction, on a second side of the second movable contact opposite to the first side. Thus, a resultant force of Lorentz forces acting on the movable element near the second movable contact is directed in a direction for bringing the fixed contact and the second movable contact into contact with each other.

With such the construction, the Lorentz forces in the direction opposing the electromagnetic repulsive force are applied to the two positions of the vicinity of the first movable contact and the vicinity of the second movable contact. Accordingly, the separation between the movable contacts and the fixed contacts due to the electromagnetic repulsive force can be inhibited.

According to a fourth example aspect of the present invention, in the electromagnetic relay of the third example aspect, the movable element has a first magnet-side plate portion that is close to the first magnet and that extends in the reference direction, a second magnet-side plate portion that is close to the second magnet and that extends in the reference direction, and a connecting plate portion that is inclined with respect to the reference direction and that connects an end portion of the first magnet-side plate portion on a first end side with respect to the reference direction and an end portion of the second magnet-side plate portion on a second end side with respect to the reference direction opposite to the first end side.

The movable element is formed in a Z-shape when viewed along the movement direction of the movable element. The first movable contact is arranged in an end portion of the first magnet-side plate portion on the second end side with respect to the reference direction. The second movable contact is arranged in an end portion of the second magnet-side plate portion on the first end side with respect to the reference direction. The first magnet has a north pole positioned on the movable element side. The second magnet has a south pole positioned on the movable element side.

With such the construction, since the movable element is formed in the Z-shape when viewed along the movement direction of the movable element, length of the movable element in the reference direction can be shortened (refer to FIG. 8).

According to a fifth example aspect of the present invention, in the electromagnetic relay of the third example aspect, the movable element has a first magnet-side plate portion that is close to the first magnet and that extends in the reference direction, a second magnet-side plate portion that is close to the second magnet and that extends in the reference direction, and a connecting plate portion that is perpendicular to the reference direction and that connects an end portion of the first magnet-side plate portion on a first end side with respect to the reference direction and an end portion of the second magnet-side plate portion on the first end side with respect to the reference direction.

The movable element is formed in a U-shape having angled corners when viewed along the movement direction of the movable element. The first movable contact is arranged in an end portion of the first magnet-side plate portion on a second end side with respect to the reference direction opposite to the first end side. The second movable contact is arranged in an end portion of the second magnet-side plate portion on the second end side with respect to the reference direction. The first magnet has a north pole positioned on the movable element side. The second magnet has a north pole positioned on the movable element side.

According to a sixth example aspect of the present invention, an electromagnetic relay has a coil for generating an electromagnetic force when energized, a movable member capable of being attracted by the electromagnetic force of the coil, two fixed contact retainers having fixed contacts, a plate-like movable element having a first movable contact and a second movable contact capable of contacting the fixed contacts and separating from the fixed contacts, a contact pressure spring for biasing the movable element in a direction for bringing the fixed contacts and the first and second movable contacts into contact with each other, and a magnet arranged to be lateral to an outer periphery of a movable contact intermediate portion of the movable element positioned between the first movable contact and the second movable contact.

When the movable member is attracted by the electromagnetic force of the coil, the movable member moves in a direction for separating from the movable element and the fixed contacts contact the first movable contact and the second movable contact because the contact pressure spring biases the movable element. A Lorentz force acting on the movable element is directed in a direction for bringing the fixed contacts and the first and second movable contacts into contact with each other.

With such the construction, the separation between the movable contacts and the fixed contacts due to the electromagnetic repulsive force can be inhibited.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENT

Hereinafter, embodiments of the present invention will be explained with reference to the drawings. The same sign is used for identical or equivalent components among the following respective embodiments and the drawings.

First Embodiment

Figure 1:
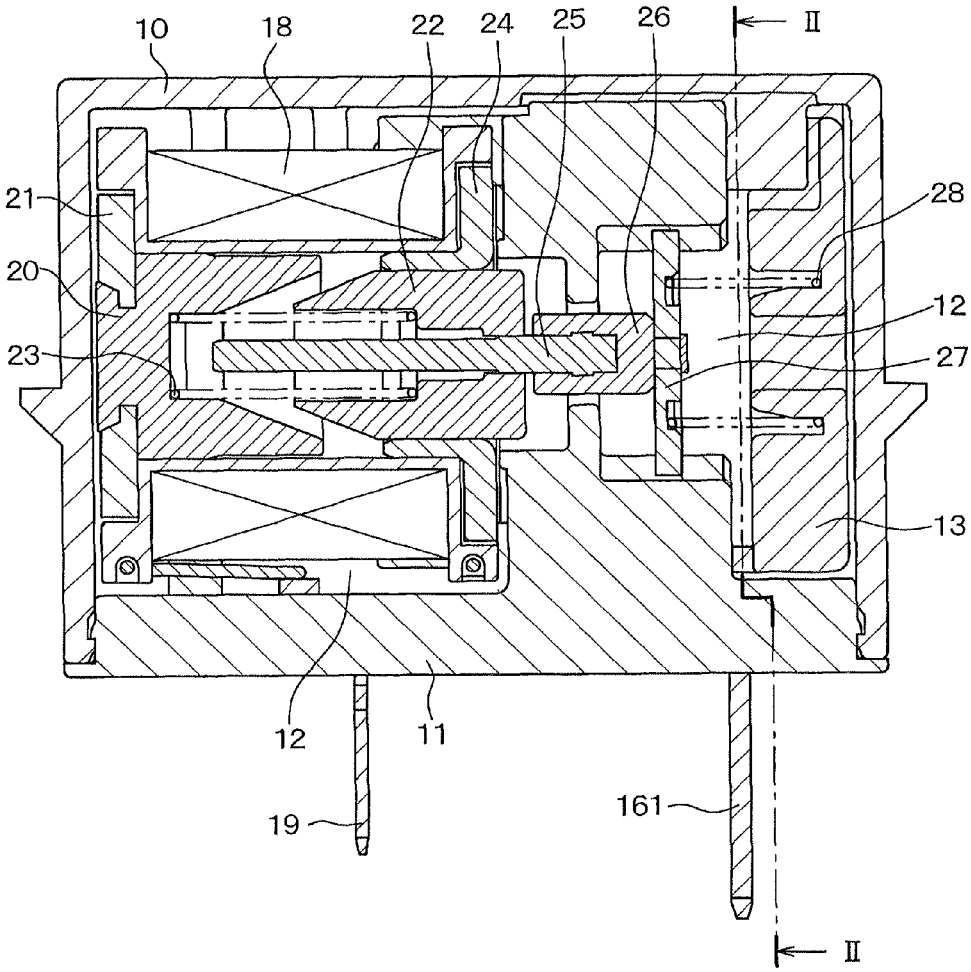
FIG. 1 is a cross-sectional view showing an electromagnetic relay according to a first embodiment of the present invention.
Figure 2:
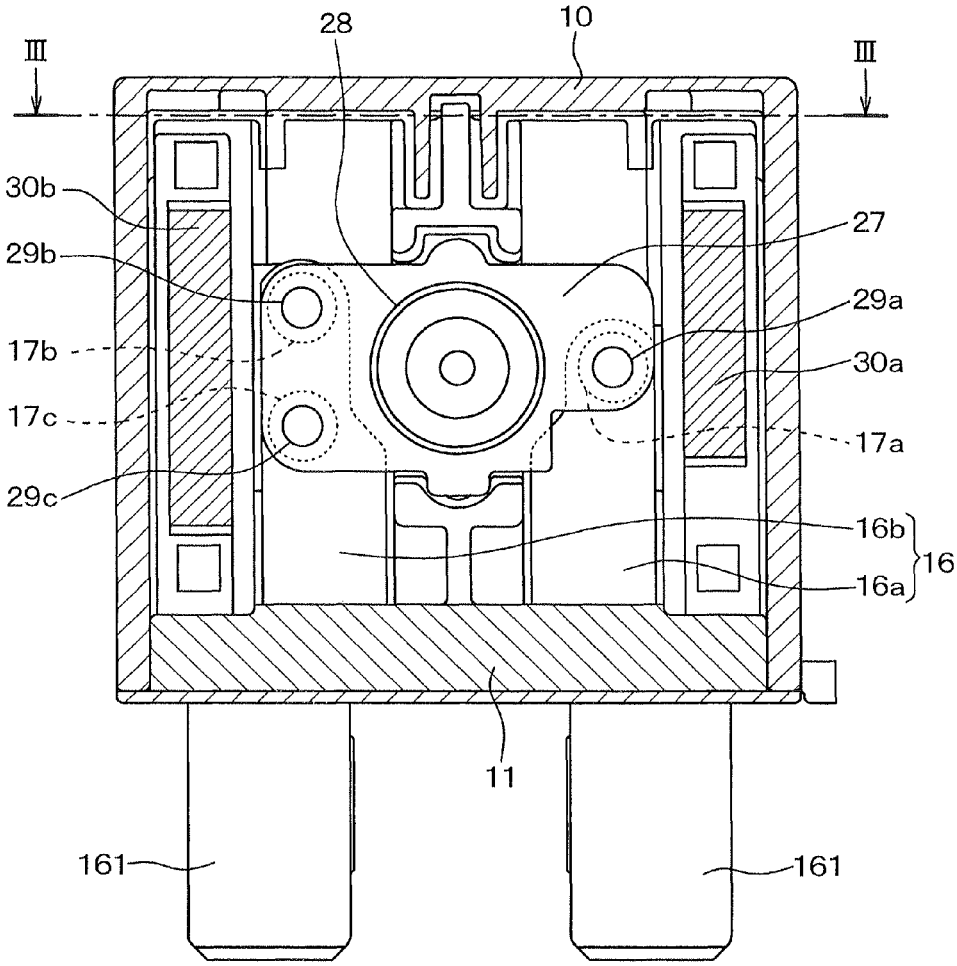
FIG. 2 is a cross-sectional view showing the electromagnetic relay of FIG. 1 taken along the line II-II.
Figure 3:
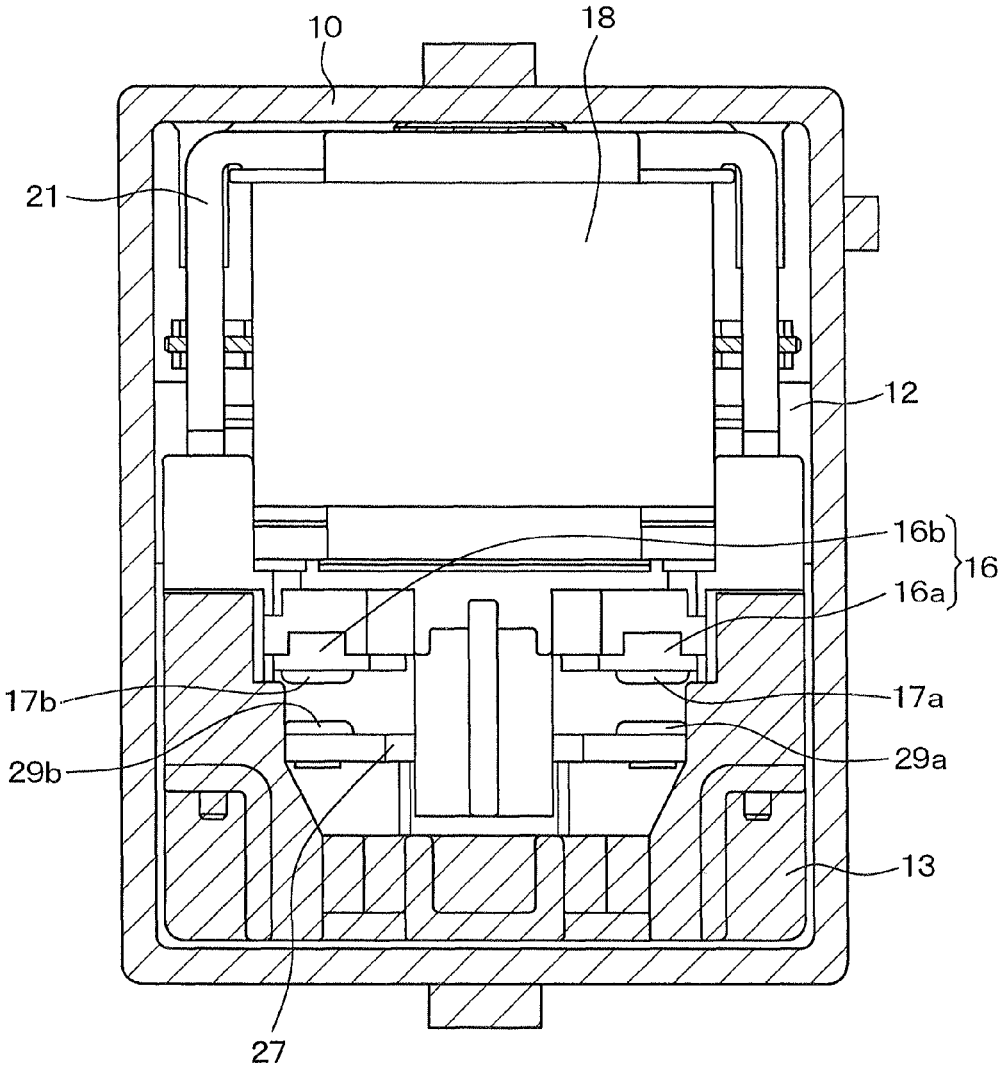
FIG. 3 is a cross-sectional view showing the electromagnetic relay of FIG. 2 taken along the line III-III.

FIG. 1 is a cross-sectional view showing an electromagnetic relay according to a first embodiment of the present invention. FIG. 2 is a cross-sectional view showing the electromagnetic relay of FIG. 1 taken along the line II-II. FIG. 3 is a cross-sectional view showing the electromagnetic relay of FIG. 2 taken along the line III-III.

As shown in FIGS. 1 to 3, the electromagnetic relay according to the present embodiment has a plastic case 10, which is formed in the shape of a rectangular tube with a bottom and substantially in the shape of a cube, only one side of which is open. A plastic base 1 is connected to the case 10 to block the opening of the case 10. The case 10 and the base 1 define an accommodation space 12, in which a plastic cover 13 is arranged.

Two fixed contact retainers 16, each of which is made of a conductive metal, are fixed to the base 11. Each fixed contact retainer 16 penetrates through the base 11. An end of each fixed contact retainer 16 is positioned in the accommodation space 12, and the other end of the same extends to an exterior space. Concrete constructions of the two fixed contact retainers 16 are different from each other (as described in detail later). Hereinafter, one of the fixed contact retainers 16 will be referred to also as a first fixed contact retainer 16*a*, and the other one of the fixed contact retainers 16 will be referred to also as a second fixed contact retainer 16*b*.

A load circuit terminal 161 connected with an external harness (not shown) is formed in an end portion of each fixed contact retainer 16 on the exterior space side. The load circuit terminal 161 of the first fixed contact retainer 16*a* is connected to a power supply (not shown) via the external harness. The load circuit terminal 161 of the second fixed contact retainer 16*b* is connected to an electrical load (not shown) via the external harness.

A first fixed contact 17*a* made of a conductive metal is caulked and fixed to an end portion of the first fixed contact retainer 16*a* on the accommodation space 12 side. A second fixed contact 17*b* made of a conductive metal and a third fixed contact 17*c* made of a conductive metal are caulked and fixed to an end portion of the second fixed contact retainer 16*b* on the accommodation space 12 side.

A cylindrical coil 18, which generates an electromagnetic force when energized, is arranged in the accommodation space 12. Two coil terminals 19, each of which is made of a conductive metal, are connected to the coil 18. One end of each coil terminal 19 penetrates through the base 11 and protrudes to the external space to be connected to an ECU (not shown) via the external harness. The coil 18 is energized through the external harness and the coil terminal 19.

A fixed core 20 made of a magnetic metallic material is arranged in an inner peripheral space of the coil 18. A yoke 21 made of a magnetic metallic material is arranged on an axial end face side and an outer peripheral side of the coil 18. Both ends of the yoke 21 are fitted and fixed to the cover 13. The fixed core 20 is retained by the yoke 21.

A movable core 22 made of a magnetic metal is arranged in a position facing the fixed core 20 in the inner peripheral space of the coil 18. A return spring 23 is arranged between the fixed core 20 and the movable core 22 for biasing the movable core 22 to a side opposite to the fixed core 20. If the coil 18 is energized, the movable core 22 is attracted toward the fixed core 20 side against the return spring 23.

A flanged cylindrical plate 24 made of a magnetic metallic material is arranged on the other axial end face side of the coil 18. The movable core 22 is slidably retained by the plate 24. The fixed core 20, the yoke 21, the movable core 22 and the plate 24 constitute a magnetic path of a magnetic flux induced by the coil 18.

A metallic shaft 25 penetrates through and is fixed to the movable core 22. One end of the shaft 25 extends toward the cover 13 side. An insulator 26 made of a resin having a high electric insulation property is fitted and fixed to the end, portion of the shaft 25 on the cover 13 side. The movable core 22, the shaft 25 and the insulator 26 constitute a movable member according to the present invention.

A plate-like movable element 27 made of a conductive metal is arranged in a space surrounded by the base 11 and the cover 13 in the accommodation space 12. A contact pressure spring 28 for biasing the movable element 27 toward the fixed contact retainers 16 is arranged between the movable element 27 and the cover 13.

A first movable contact 29*a* made of a conductive metal is caulked and fixed to the movable element 27 at a position facing the first fixed contact 17*a*. A second movable contact 29*b* made of a conductive metal is caulked and fixed to the movable element 27 at a position facing the second fixed contact 17*b*. A third movable contact 29*c* made of a conductive metal is caulked and fixed to the movable element 27 at a position facing the third fixed contact 17*c*. If the movable core 22 and the like are driven to the fixed core 20 side by the electromagnetic force, the three fixed contacts 17*a*-17*c* contact the three movable contacts 29*a*-29*c*.

First and second permanent magnets 30*a*, 30*b* are arranged to be lateral to an outer peripheral side of the movable element 27. More specifically, the first permanent magnet 30*a* is arranged to be lateral to the first fixed contact 17*a* and the first movable contact 29*a*. The second permanent magnet 30*b* is arranged to be lateral to the second fixed contact 17*b*, the third fixed contact 17*c*, the second movable contact 29*b* and the third movable contact 29*c*.

Figure 4:
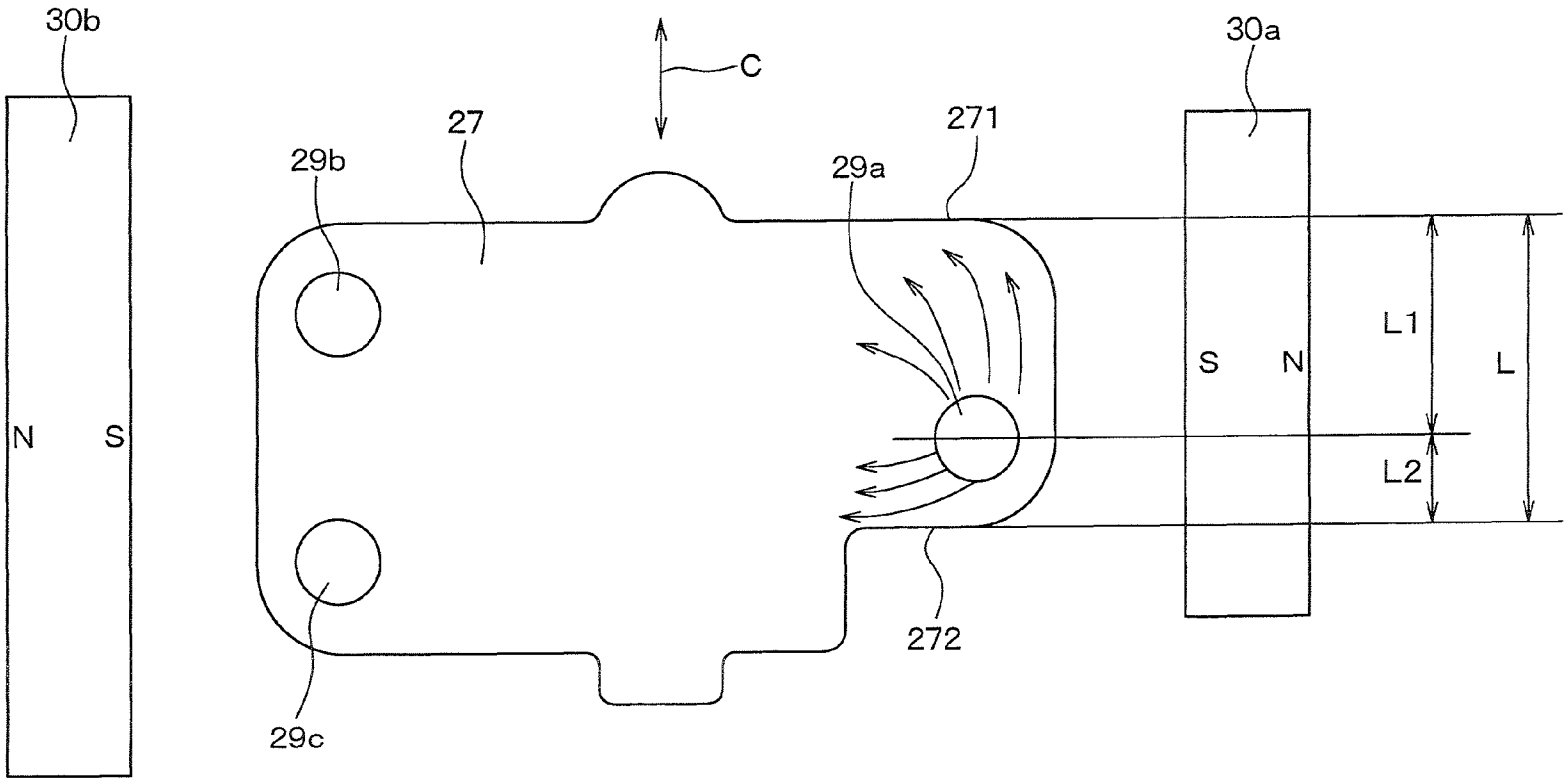
FIG. 4 is a schematic diagram showing a movable element and permanent magnets of the electromagnetic relay according to the first embodiment.

FIG. 4 is a schematic diagram showing the movable element 27 and the permanent magnets 30*a*, 30*b*. Arrow marks in FIG. 4 show flow of current near the first movable contact 29*a*. As shown in FIG. 4, a south pole of the first permanent magnet 30*a* is positioned on the movable element 27 side, and a north pole of the same is positioned on an opposite side from the movable element 27. A south pole of the second permanent magnet 30*b* is positioned on the movable element 27 side, and a north pole of the same is provided on an opposite side from the movable element 27.

A direction, which is perpendicular to both of a line connecting the north pole and the south pole of the first permanent magnet 30*a* and a movement direction of the movable element 27, is defined as a reference direction C as shown in FIG. 4.

Length L of the movable element 27 measured along a line passing through the first movable contact 29*a* in the reference direction C is divided into movable element first end side length L1 and movable element second end side length L2. The movable element first end side length L1 extends from the first movable contact 29*a* to an end portion 271 of the movable element 27 on a first end side with respect to the reference direction C. The movable element second end side length L2 extends from the first movable contact 29*a* to another end portion 272 of the movable element 27 on a second end side with respect to the reference direction C opposite to the first end side.

In the present embodiment, the movable element first end side length L1 is set greater than the movable element second end side length L2.

If the current flows through the movable element 27, a Lorentz force acts on the movable element 27. A direction of the Lorentz force is decided by directions of the current and a magnetic flux. Hereafter, a Lorentz force acting on a portion of the movable element 27 extending from the first movable contact 29*a* to the first end side end portion 271 will be referred to as a first side Lorentz force F1. In the present embodiment, arrangement of, the north pole and the south pole of the first permanent magnet 30*a* is set such that a direction of the first side Lorentz force F1 coincides with a direction for biasing the movable element 27 toward the fixed contact retainers 16. That is, the arrangement of the north pole and the south pole of the first permanent magnet 30*a* is set such that the direction of the first side Lorentz force F1 coincides with a direction for bringing the movable contacts 29*a*-29*c* into contact with the fixed contacts 17*a*-17*c*.

Hereafter, a Lorentz force acting on a portion of the movable element 27 extending from the first movable constant 29*a* to the second end side end portion 272 will be referred to as a second side Lorentz force F2. A direction of the second side Lorentz force F2 coincides with a direction for separating the movable element 27 from the fixed contact retainers 16. That is, the second side Lorentz force F2 is directed in a direction for separating the movable contacts 29*a*-29*c* from the fixed contacts 17*a*-17*c*. The direction of the first side Lorentz force F1 is opposite to the direction of the second side Lorentz force F2.

Next, an operation of the electromagnetic relay according to the present embodiment will be explained. If the coil 18 is energized, the movable core 22, the shaft 25 and the insulator 26 are attracted toward the fixed core 20 side by the electromagnetic force, against the return spring 23. The movable element 27 is biased by the contact pressure spring 28 and moves to follow the movable core 22 and the like. Thus, the movable contacts 29*a*-29*c* contact the respective fixed contacts 17*a*-17*c* opposed to the movable contacts 29*a*-29*c* respectively. Thus, conduction between the two load circuit terminals 161 is established, and the current flows through the movable element 27 and the like. After the movable contacts 29*a*-29*c* contact the fixed contacts 17*a*-17*c*, the movable core 22 and the like further move toward the fixed core 20 side, whereby the insulator 26 separates from the movable element 27.

When the conduction between the two load circuit terminals 161 is established and the current flows through the movable element 27, the Lorentz force acts on the movable element 27. As mentioned above the direction of the first side Lorentz force F1 is opposite to the direction of the second side Lorentz force F2.

As shown in FIG. 4, the movable element first end side length L1 is set greater than the movable element second end side length L2. Therefore, a direction of the current flowing between the first movable contact 29*a* and the first end side end portion 271 of the movable element 27 tends to become parallel to the reference direction C. When the direction of the current is parallel to or substantially parallel to the reference direction C in this way, the Lorentz force is relatively large. A direction of the current flowing between the first movable contact 29*a* and the second end side end portion 272 of the movable element 27 tends to become inclined with respect to the reference direction C. When the direction of the current is inclined with respect to the reference direction C in this way, the Lorentz force is relatively small.

Therefore, the first side Lorentz force F1 is larger than the second side Lorentz force F2. A resultant Lorentz force as the sum of the first side Lorentz force F1 and the second side Lorentz force F2 is a force in a direction for bringing the movable contacts 29*a*-29*c* into contact with the fixed contacts 17*a*-17*c*. Since the resultant Lorentz force is the force opposing an electromagnetic repulsive force, separation between the movable contacts 29*a*-29*c* and the fixed contacts 17*a*-17*c* due to the electromagnetic repulsive force can be inhibited.

If the energization to the coil 18 is cut off, the movable core 22, the movable element 27 and the like are biased toward the side opposite to the fixed core 20 by the return spring 23 against the contact pressure spring 28. Thus, the movable contacts 29*a*-29*c* are separated from the fixed contacts 17*a*-17*c*, and the conduction between the two load circuit terminals 161 is cut off.

At this time, the first permanent magnet 30*a* applies the Lorentz force to an arc, which is generated when the first movable contact 29*a* separates from the first fixed contact 17*a*. The Lorentz force extends the arc, thereby cutting off the arc. The second permanent magnet 30*b* applies the Lorentz forces to an arc, which is generated when the second movable contact 29*b* separates from the second fixed contact 17*b*, and to an arc, which is generated when the third movable contact 29*c* separates from the third fixed contact 17*c*. Thus, the Lorentz forces extend the arcs, thereby cutting off the arcs.

Second Embodiment

Figure 5:
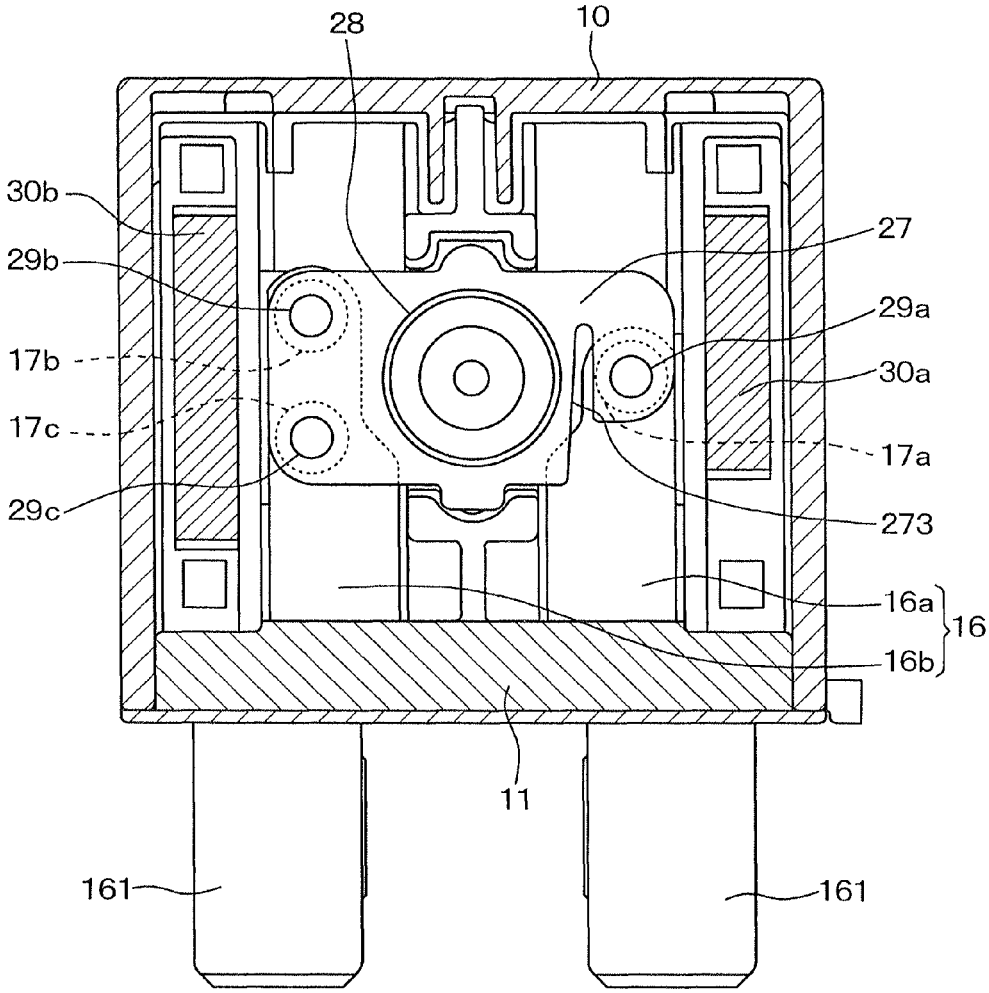
FIG. 5 is a cross-sectional view showing an electromagnetic relay according to a second embodiment of the present invention.

Next, a second embodiment of the present invention will be explained. FIG. 5 is a cross-sectional view showing an electromagnetic relay according to the second embodiment. The construction of the movable element of the second embodiment is modified from that of the first embodiment, but the other construction is the same. Therefore, only differences from the first embodiment will be explained in the following description.

As shown in FIG. 5, the movable element 27 according to the present embodiment has a notch 273 lateral to the first movable contact 29*a*. The notch 273 is positioned between the first movable contact 29*a* and the other movable contacts 29*b*, 29*c*.

The notch 273 extends from the second end side end portion 272 of the movable element 27 along the reference direction C. More specifically, the notch 273 extends toward the first end side end portion 271 of the movable element 27 further than the first movable contact 29*a*.

Figure 6:
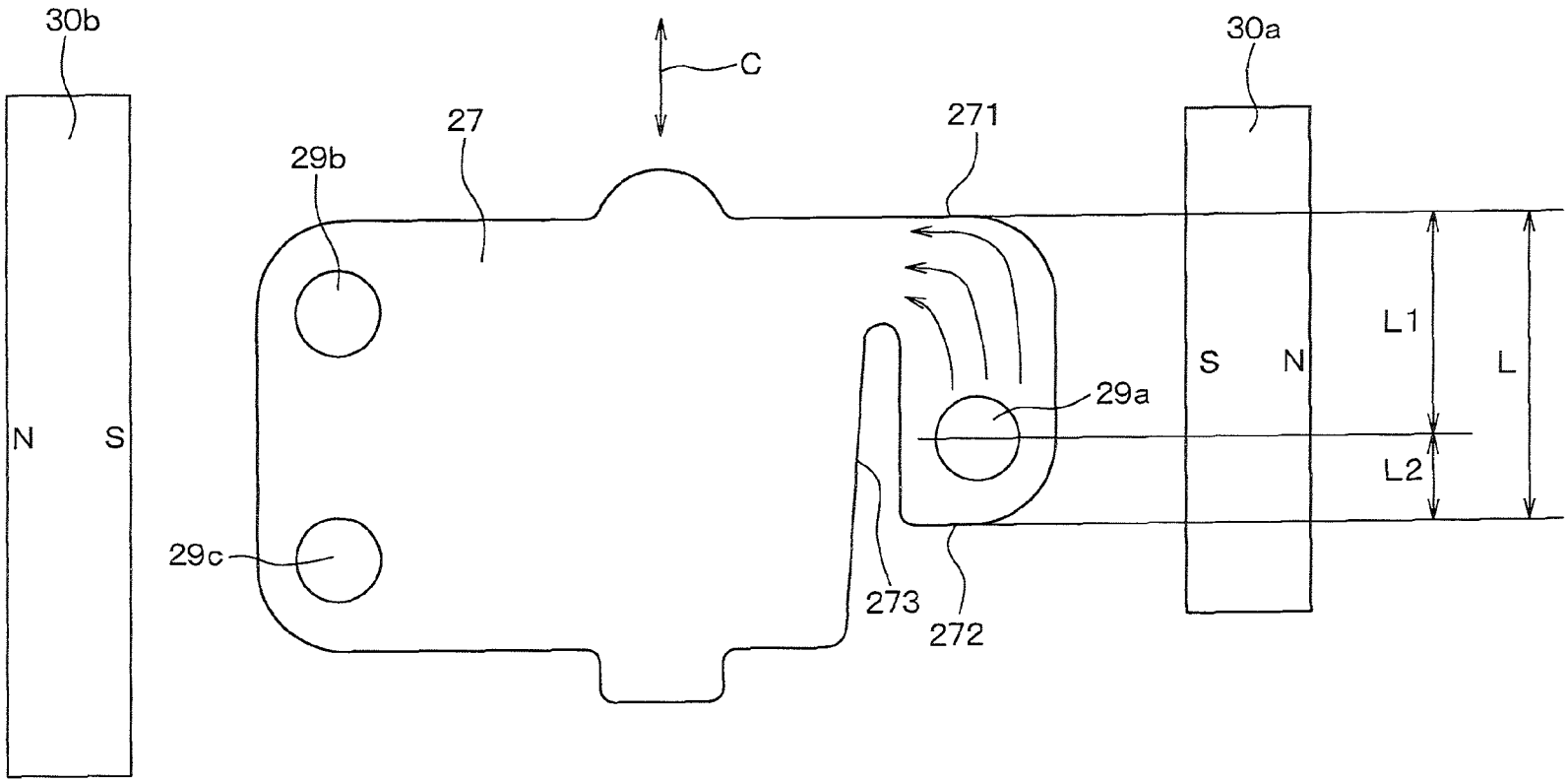
FIG. 6 is a schematic diagram showing a movable element and permanent magnets of the electromagnetic relay according to the second embodiment.

FIG. 6 is a schematic diagram showing the movable element 27 and the permanent magnets 30*a*, 30*b* according to the present embodiment. Arrow marks in FIG. 6 show flow of current near the first movable contact 29*a*. Since the notch 273 is formed as shown in FIG. 6 according to the present embodiment, the current flowing through the movable element 27 cannot flow linearly from the first movable contact 29*a* toward the other movable contacts 29*b*, 29*c*. Therefore, the direction of the current flowing between the first movable contact 29*a* and the first end side end portion 271 of the movable element 27 is more apt to become parallel to the reference direction C than in the electromagnetic relay according to the first embodiment.

Therefore, the Lorentz force in the direction for bringing the movable contacts 29*a*-29*c* into contact with the fixed contacts 17*a*-17*c* increases. Accordingly, the separation between the movable contacts 29*a*-29*c* and the fixed contacts 17*a*-17*c* due to the electromagnetic repulsive force can be inhibited more.

Third Embodiment

Figure 7:
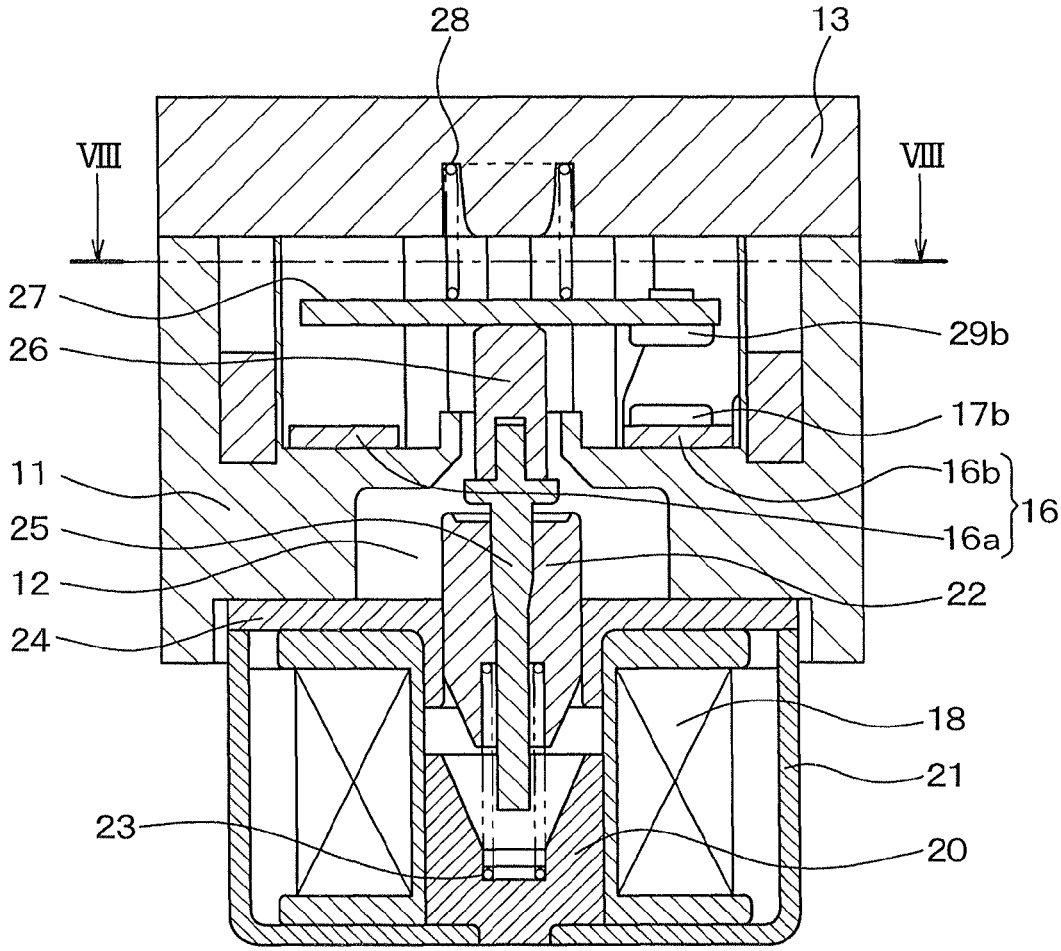
FIG. 7 is a cross-sectional view showing an electromagnetic relay according to a third embodiment of the present invention.
Figure 8:
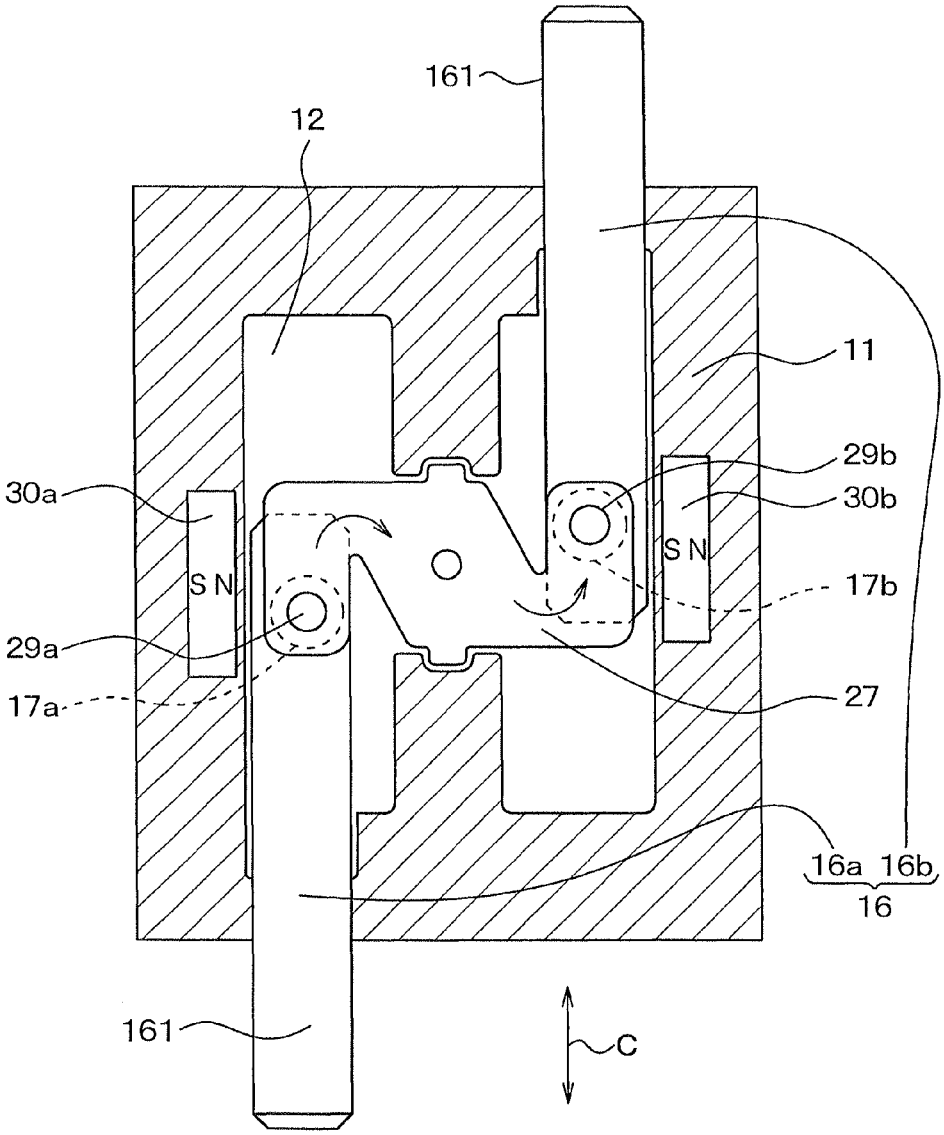
FIG. 8 is a cross-sectional view showing the electromagnetic relay of FIG. 7 taken along the line VIII-VIII.

Next, a third embodiment of the present invention will be explained. FIG. 7 is a cross-sectional view showing an electromagnetic relay according to the third embodiment FIG. 8 is a cross-sectional view showing the electromagnetic relay of FIG. 7 taken along the line VIII-VIII. The construction of the movable element, the number of the fixed contacts, the number of the movable contacts and the like of the present embodiment are modified from those of the first embodiment, but the other construction is the same. Therefore, only differences from the first embodiment will be explained in the following description.

As shown in FIGS. 7 and 8, the electromagnetic relay according to the present embodiment does not have the case 10 used in the first embodiment. The accommodation space 12 is formed in the base 11, which is formed substantially in the shape of a cube. One opening of the accommodation space 12 is blocked by the cover 13. The other opening of the accommodation space 12 is blocked by a solenoid section composed of the coil 18, the fixed core 20, the yoke 21 and the plate 24.

The load circuit terminal 161 of the first fixed contact retainer 16*a* and the load circuit terminal 161 of the second fixed contact retainer 16*b* protrude to an outside at diagonal positions of the base 11 respectively as shown in FIG. 8. A single fixed contact, i.e., only the second fixed contact 17*b*, is caulked and fixed to the second fixed contact retainer 16*b*.

Two movable contacts, i.e., the first movable contact 29*a* and the second movable contact 29*b*, are caulked and fixed to the movable element 27. If the movable core 22 and the like are driven toward the fixed core 20 side by the electromagnetic force, the two fixed contacts 17*a*, 17*b* contact the two movable contacts 29*a*, 29*b* respectively.

Figure 9:
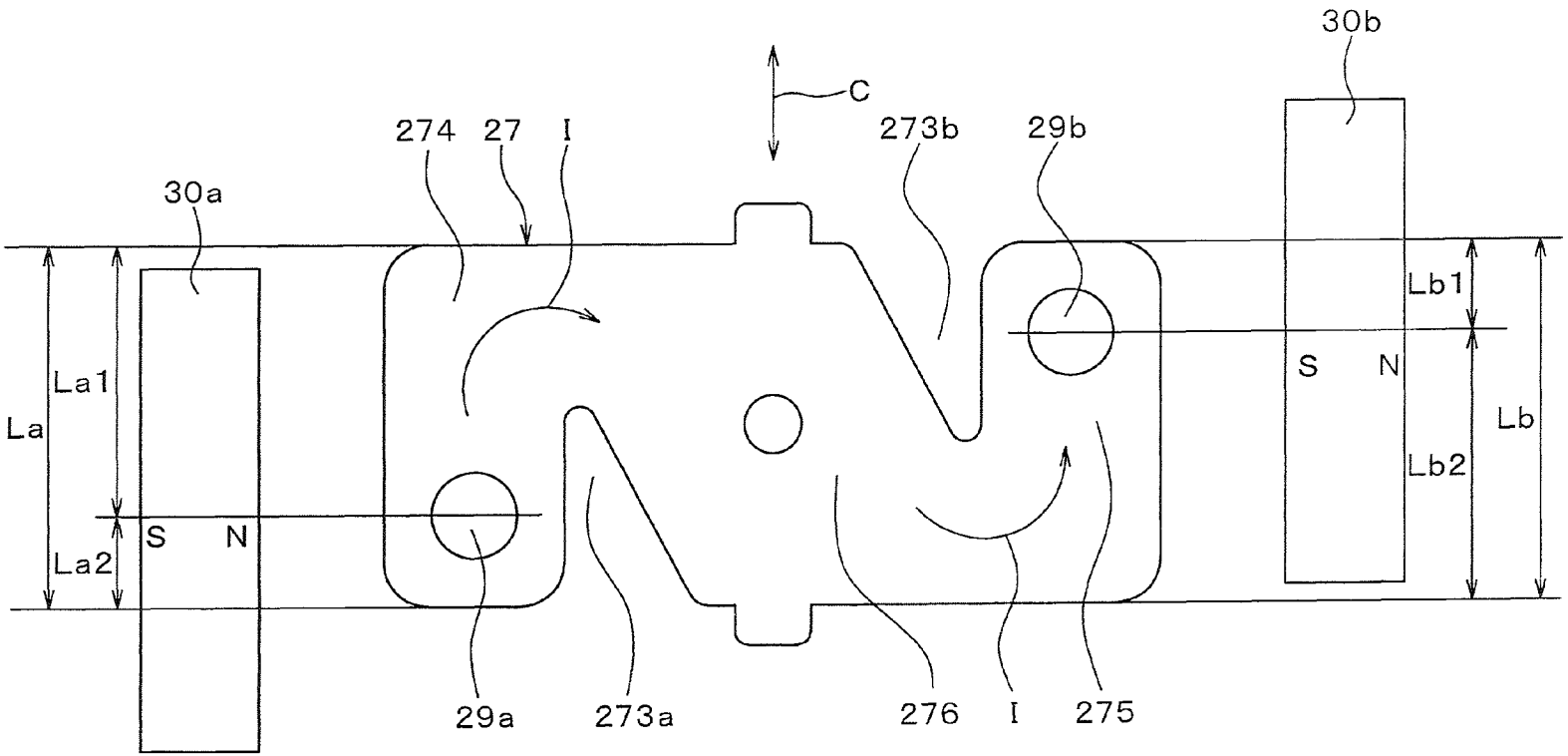
FIG. 9 is a schematic diagram showing a movable element and permanent magnets of the electromagnetic relay according to the third embodiment.

FIG. 9 is a schematic diagram showing the movable element 27 and the permanent magnets 30*a*, 30*b* according to the present embodiment Arrow marks I in FIG. 9 show flow of current in the movable element 27. The current I flows from the first movable contact 29*a* side to the second movable contact 29*b* side.

As shown in FIG. 9, the north pole of the first permanent magnet 30*a* is positioned on the movable element 27 side, and the south pole of the same is positioned on a side opposite to the movable element 27. The south pole of the second permanent magnet 30*b* is positioned on the movable element 27 side, and the north pole of the same is positioned on a side opposite to the movable element 27.

A line connecting the north pole and the south pole of the first permanent magnet 30*a* is parallel to a line connecting the north pole and the south pole of the second permanent magnet 30*b*. The first permanent magnet 30*a* and the second permanent magnet 30*b* are spaced from each other in a direction of the line connecting the north pole and the south pole of the first permanent magnet 30*a* to sandwich the movable element 27 therebetween.

The movable element 27 has a first magnet-side plate portion 274, a second magnet-side plate portion 275 and a connecting plate portion 276. The first magnet-side plate portion 274 is provided near the first permanent magnet 30*a* and extends in the reference direction C. The second magnet-side plate portion 275 is provided near the second permanent magnet 30*b* and extends in the reference direction C. The connecting plate portion 276 is inclined with respect to the reference direction C. The connecting plate portion 276 connects an end side (i.e., downstream side of current flow) of the first magnet-side plate portion 274 on a first end side with respect to the reference direction C and an end side (i.e., upstream side of current flow) of the second magnet-side plate portion 275 on a second end side with respect to the reference direction C opposite to the first end side.

More specifically, the movable element 27 has a V-shaped first notch 273*a* lateral to the first movable contact 29*a* and a V-shaped second notch 273*b* lateral to the second movable contact 29*b*.

The first notch 273*a* is formed between the first magnet-side plate portion 274 and the connecting plate portion 276. The first notch 273*a* extends from an end portion of the first magnet-side plate portion 274 on the second end side with respect to the reference direction C to a position further than the first movable contact 29*a* along the reference direction C.

The second notch 273*b* is formed between the second magnet-side plate portion 275 and the connecting plate portion 276. The second notch 273*b* extends from an end portion of the second magnet-side plate portion 275 on the first end side with respect to the reference direction C to a position further than the second movable contact 29*b* along the reference direction C.

The movable element 27 constructed as above is formed in a Z-shape when viewed along the movement direction of the movable element 27.

The first movable contact 29*a* is arranged in a portion of the first magnet-side plate portion 274 on the second end side with respect to the reference direction C. The second movable contact 29*b* is arranged in a portion of the second magnet-side plate portion 275 on the first end side with respect to the reference direction C.

Length La of the first magnet-side plate portion 274 measured along a line passing through the first movable contact 29*a* in the reference direction C is divided into first plate portion first end side length La1 and first plate portion second end side length La1. The first plate portion first end side length La1 extends from the first movable contact 29*a* to an end of the first magnet-side plate portion 274 on the first end side with respect to the reference direction C. The first plate portion second end side length La2 extends from the first movable contact 29*a* to another end of the first magnet-side plate portion 274 on the second end side with respect to the reference direction C.

The first plate portion first end side length La1 is differentiated from the first plate portion second end side length La2. More specifically, the first plate portion first end side length La1 is set greater than the first plate portion second end side length La2. Thus, a resultant force of Lorentz forces acting on the movable element 27 near the first movable contact 29*a* is directed in a direction for bringing the first fixed contact 17*a* and the first movable contact 29*a* into contact with each other.

Length Lb of the second magnet-side plate portion 275 measured along a line passing through the second movable contact 29*b* in the reference direction C is divided into second plate portion first end side length Lb1 and second plate portion second end side length Lb2. The second plate portion first end side length Lb1 extends from the second movable contact 29*b* to an end of the second magnet-side plate portion 275 on the first end side with respect to the reference direction C. The second plate portion second end side length Lb2 extends from the second movable contact 29*b* to another end of the second magnet-side plate portion 275 on the second end side with respect to the reference direction C.

The second plate portion first end side length Lb1 is differentiated from the second plate portion second end side length Lb2. More specifically, the second plate portion second end side length Lb2 is set greater than the second plate portion first end side length Lb1. Thus, a resultant force of Lorentz forces acting on the movable element 27 near the second movable contact 29*b* is directed in a direction for bringing the second fixed contact 17*b* and the second movable contact 29*b* into contact with each other.

Next, an operation of the electromagnetic relay according to the present embodiment will be explained. If the coil 18 is energized, the movable core 22, the shaft 25 and the insulator 26 are attracted toward the fixed core 20 side by the electromagnetic force against the return spring 23. The movable element 27 is biased by the contact pressure spring 28 and moves to follow the movable core 22 and the like. As a result, the movable contacts 29*a*, 29*b* contact the fixed contacts 17*a*, 17*b* opposed to the movable contacts 29*a*, 29*b* respectively. Thus, conduction is established between the two load circuit terminals 161, and the current I flows through the movable element 27 and the like.

The first notch 273*a* is formed as shown in FIG. 9. Therefore, a direction of the current I flowing from the first movable contact 29*a* toward the connecting plate, portion 276 in the first magnet-side plate portion 274 tends to become parallel to the reference direction C, i.e., perpendicular to the line connecting the north pole and the south pole of the first permanent magnet 30*a*. Little or no current flows from the first movable contact 29*a* to a side opposite to the connecting plate portion 276 in the first magnet-side plate portion 274. Therefore a Lorentz force acting on the movable element 27 near the first movable contact 29*a*, i.e., a Lorentz force in a direction for bringing the first movable contact 29*a* into contact with the first fixed contact 17*a*, is relatively large.

In addition, the second notch 273*b* is formed. Therefore, a direction of the current I flowing from the connecting plate portion 276 toward the second movable contact 29*b* in the second magnet-side plate portion 275 tends to become parallel to the reference direction C, i.e., perpendicular to the line connecting the north pole and the south pole of the second permanent magnet 30*b*. Little or no current flows from a side opposite to the connecting plate portion 276 to the second movable contact 29*b* in the second magnet-side plate portion 275. Therefore, a Lorentz force acting on the movable element 27 near the second movable contact 29*b*, i.e., a Lorentz force in a direction for bringing the second movable contact 29*b* into contact with the second fixed contact 17*b*, is relatively large.

In this way, according to the present embodiment, the Lorentz forces opposing the electromagnetic repulsive force are applied to two positions of the vicinity of the first movable contact 29*a* and the vicinity of the second movable contact 29*b*. Further, the Lorentz forces acting on the vicinity of the first movable contact 29*a* and the vicinity of the second movable contact 29*b* are set relatively large. Accordingly, separation between the movable contacts 29*a*, 29*b* and the fixed contacts 17*a*, 17*b* due to the electromagnetic repulsive force can be inhibited.

The movable element 27 is formed in the Z-shape when viewed along the movement direction of the movable element 27. Therefore, length of the movable element 27 in the reference direction C can be shortened.

Fourth Embodiment

Figure 10:
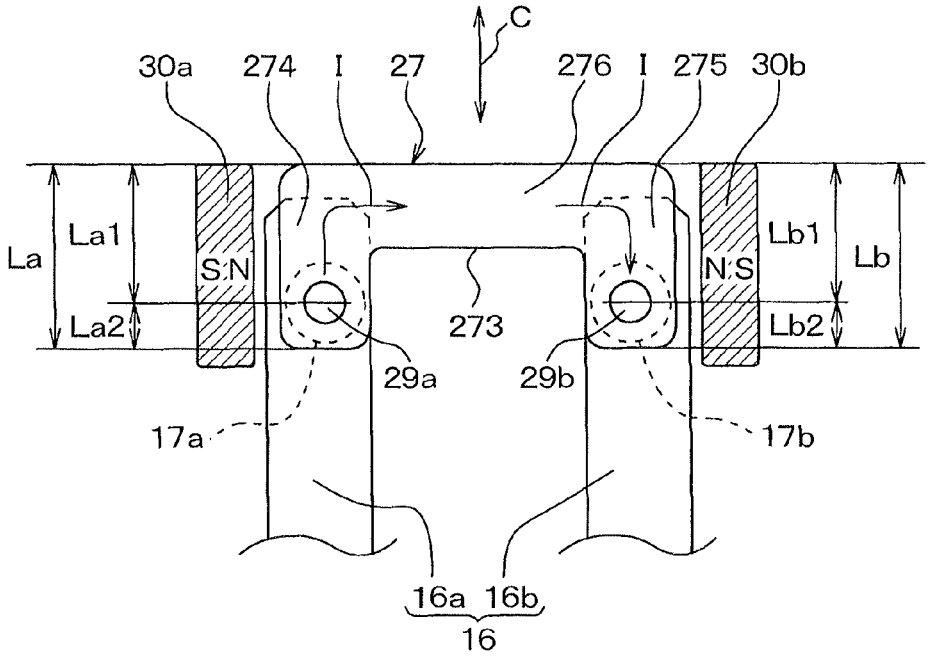
FIG. 10 is a schematic diagram showing fixed contact retainers, a movable element and permanent magnets of an electromagnetic relay according to a fourth embodiment of the present invention.

Next a fourth embodiment of the present invention will be explained. FIG. 10 is a schematic diagram showing the fixed contact retainers, the movable element and the permanent magnets of the electromagnetic relay according to the fourth embodiment. The arrangement of the fixed contact retainers, the construction of the movable element and polarity arrangement of the permanent magnets according to the present embodiment are modified from those of the third embodiment. The other construction is the same as the third embodiment. Therefore, only differences from the third embodiment will be explained in the following description.

As shown in FIG. 10, the first fixed contact retainer 16*a* and the second fixed contact retainer 16*b* are arranged adjacent and parallel to each other. The load circuit terminals (not shown) of the first and second fixed contact retainers 16*a*, 16*b* protrude from a common side surface of the base 11 (refer to FIG. 8) to an outside.

The north pole of the second permanent magnet 30*b* is positioned on the movable element 27 side, and the south pole of the second permanent magnet 30*b* is positioned on a side opposite to the movable element 27.

The connecting plate portion 276 of the movable element 27 extends in a direction perpendicular to the reference direction C. The connecting plate portion 276 connects an end portion (i.e., current flow downstream side) of the first magnetic-side plate portion 274 on the first end side with respect to the reference direction C and an end portion (i.e., current flow upstream side) of the second magnet-side plate portion 275 on the first end side with respect to the reference direction C as shown in FIG. 10.

More specifically, the notch 273 is formed between the first magnet-side plate portion 274 and the second magnet-side plate portion 275. The notch 273 extends from end portions of the first magnet-side plate portion 274 and the second magnet-side plate portion 275 on the second end side with respect to the reference direction C, which is opposite to the first end side, to a position further than the first movable contact 29*a* and the second movable contact 29*b* along the reference direction C.

The movable element 27 constructed as above is formed in a U-shape with angled corners or in a U-shape when viewed along the movement direction of the movable element 27.

The second movable contact 29*b* is arranged in an end portion of the second magnet-side plate portion 275 on the second end side with respect to the reference direction C as shown in FIG. 10. The second plate portion first end side length Lb1 is set greater than the second plate portion second end side length Lb2 in the second magnet-side plate portion 275. Thus, a resultant force of Lorentz forces acting on the movable element 27 near the second movable contact 29*b* is directed in a direction for bringing the second fixed contact 17*b* and the second movable contact 29*b* into contact with each other.

The electromagnetic relay according to the present embodiment has the notch 273 as explained above. Therefore, a direction of the current I flowing from the first movable contact 29*a* toward the connecting plate portion 276 in the first magnet-side plate portion 274 tends to become parallel to the reference direction C, i.e., perpendicular to a line connecting the north pole and the south pole of the first permanent magnet 30*a*. Little or no current flows from the first movable contact 29*a* toward a side opposite to the connecting plate portion 276 in the first magnet-side plate portion 274. Therefore, a Lorentz force acting on the movable element 27 near the first movable contact 29*a*, i.e., a Lorentz force in a direction for bringing the first movable contact 29*a* into contact with the first fixed contact 17*a*, is relatively large.

Since the notch 273 is formed, a direction of the current I flowing from the connecting plate portion 276 toward the second movable contact 29*b* in the second magnet-side plate portion 275 tends to become parallel to the reference direction C, i.e., perpendicular to a line connecting the north pole and the south pole of the second permanent magnet 30*b*. Little or no current flows from a side opposite to the connecting plate portion 276 toward the second movable contact 29*b* in the second magnet-side plate portion 275. Therefore, a Lorentz force acting on the movable element 27 near the second movable contact 29*b*, i.e., a Lorentz force in a direction for bringing the second movable contact 29*b* into contact with the second fixed contact 17*b*, is relatively large.

Thus, according to the present embodiment, the Lorentz forces opposing the electromagnetic repulsive force are applied to two positions of the vicinity of the first movable contact 29*a* and the vicinity of the second movable contact 29*b*. The Lorentz forces acting on the vicinity of the first movable contact 29*a* and the vicinity of the second movable contact 29*b* are set relatively large. Therefore, the separation between the movable contacts 29*a*, 29*b* and the fixed contacts 17*a*, 17*b* due to the electromagnetic repulsive force can be inhibited.

Fifth Embodiment

Figure 11:
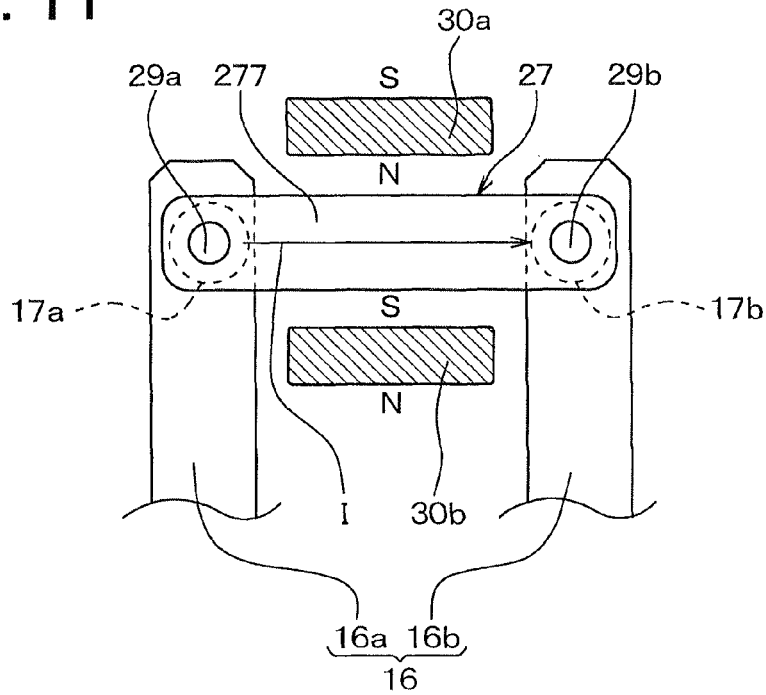
FIG. 11 is a schematic diagram showing fixed contact retainers, a movable element and permanent magnets of an electromagnetic relay according to a fifth embodiment of the present invention.

Next, a fifth embodiment of the present invention will be explained. FIG. 11 is a schematic diagram showing the fixed contact retainers, the movable element and the permanent magnets of the electromagnetic relay according to the fifth embodiment. The arrangement of the fixed contact retainers, the construction of the movable element and the arrangement of the permanent magnets according to the present embodiment are modified from those of the electromagnetic relay of the third embodiment. The other construction is the same as the third embodiment. Therefore, only differences from the third embodiment will be explained in the following description.

As shown in FIG. 11, the first fixed contact retainer 16*a* and the second fixed contact retainer 16*b* are arranged to be adjacent and parallel to each other. The load circuit terminals (not shown) of the first and second fixed contact retainers 16*a*, 16*b* protrude from a common side surface of the base 11 (refer to FIG. 8) to the outside.

The movable element 27 is formed in an I-shape or in a linear shape when viewed along the movement direction of the movable element 27. The first movable contact 29*a* is arranged in an end portion of the movable element 27 on one end side with respect to a longitudinal direction of the movable element 27. The second movable contact 29*b* is arranged in another end portion of the movable element 27 on the other end side with respect to the longitudinal direction of the movable element 27.

The movable element 27 has a movable contact intermediate portion 277 provided between the first movable contact 29*a* and the second movable contact 29*b*. The first permanent magnet 30*a* and the second permanent magnet 30*b* are arranged to be lateral to outer peripheral sides of the movable contact intermediate portion 277 to sandwich the movable element 27. Both of a line connecting the north pole and the south pole of the first permanent magnet 30*a* and a line connecting the north pole and the south pole of the second permanent magnet 30*b* are perpendicular to a line connecting the first movable contact 29*a* and the second movable contact 29*b*.

The north pole and the south pole of the first permanent magnet 30*a* are arranged such that a direction of the Lorentz force applied to the movable contact intermediate portion 277 by the current I flowing through the movable contact intermediate portion 277 and the magnetic flux of the first permanent magnet 30*a* coincides with a direction for biasing the movable element 27 toward the fixed contact retainers 16. More specifically, the north pole of the first permanent magnet 30*a* is positioned on the movable element 27 side, and the south pole of the same is positioned on a side opposite to the movable element 27.

The north pole and the south pole of the second permanent magnet 30*b* are arranged such that a direction of the Lorentz force applied to the movable contact intermediate portion 277 by the current I flowing through the movable contact intermediate portion 277 and the magnetic flux of the second permanent magnet 30*b* coincides with a direction for biasing the movable element 27 toward the fixed contact retainers 16. More specifically, the south pole of the second permanent magnet 30*b* is positioned on the movable element 27 side, and the north pole of the same is positioned on a side opposite to the movable element 27.

In the electromagnetic relay according to the present embodiment constructed as above, the current I flowing through the movable element 27 flows substantially linearly from the first movable contact 29*a* to the second movable contact 29*b*. Therefore, a line connecting the north pole and the south pole of the first permanent magnet 30*a* is perpendicular to the flow direction of the current I flowing through the movable contact intermediate portion 277. A line connecting the north pole and the south pole of the second permanent magnet 30*b* is perpendicular to the flow direction of the current I flowing through the movable contact intermediate portion 277. Therefore, the Lorentz force acting on the movable contact intermediate portion 277 of the movable element 27 is relatively large. Accordingly, the separation between the movable contacts 29*a*, 29*b* and the fixed contacts 17*a*, 17*b* due to the electromagnetic repulsive force can be inhibited.

The electromagnetic relay according to the present embodiment has the load circuit terminals 161 of the first fixed contact retainer 16*a* and the second fixed contact retainer 16*b*, both of the load circuit terminals 161 protruding from the common side surface of the base 11 to the outside. Alternatively, the present embodiment may be applied to the electromagnetic relay (refer to FIG. 8) having the load circuit terminals 161 of the first fixed contact retainer 16*a* and the second fixed contact retainer 16*b*, the load circuit terminals 161 respectively protruding from the diagonal positions of the base 11 to the outside.

Sixth Embodiment

Figure 12:
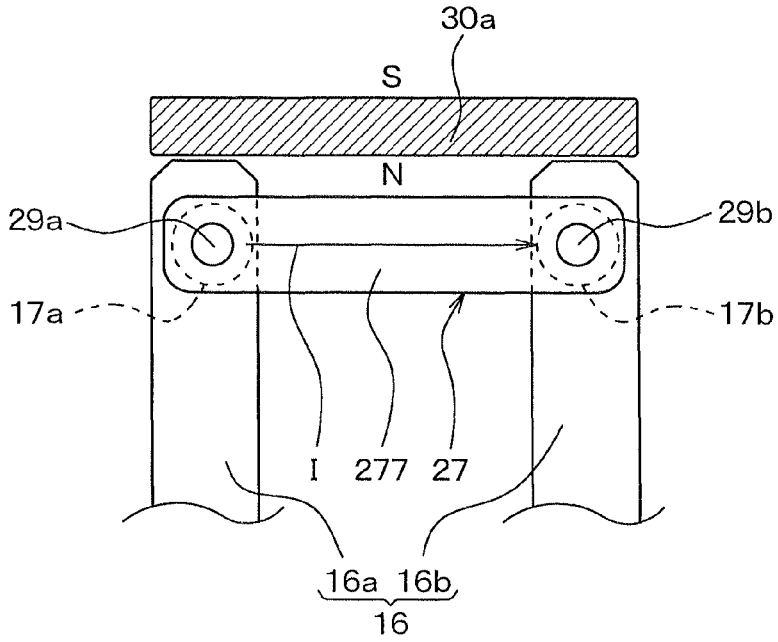
FIG. 12 is a schematic diagram showing fixed contact retainers, a movable element and a permanent magnet of an electromagnetic relay according to a sixth embodiment of the present invention.

Next, a sixth embodiment of the present invention will be explained. FIG. 12 is a schematic diagram showing the fixed contact retainers, the movable element and the permanent magnet of the electromagnetic relay according to the sixth embodiment. The number and the size of the permanent magnet of the present embodiment are modified from those of the electromagnetic relay according to the fifth embodiment. The other construction is the same. Therefore, only differences from the fifth embodiment will be explained in the following description.

As shown in FIG. 12, the electromagnetic relay according to the present embodiment has only the first permanent magnet 30*a* as the magnet. The first permanent magnet 30*a* extends to lateral sides of the first movable contact 29*a* and the second movable contact 29*b*. Accordingly, Lorentz forces are applied to arcs generated when the first and second movable contacts 29*a*, 29*b* separate from the first and second fixed contacts 17*a*, 17*b*, whereby the Lorentz forces extend and cut off the arcs.

Thus, in the electromagnetic relay according to the present embodiment, the separation between the movable contacts 29*a*, 29*b* and the fixed contacts 17*a*, 17*b* due to the electromagnetic repulsive force can be inhibited, and the arcs can be cut off.

Seventh Embodiment

Figure 13:
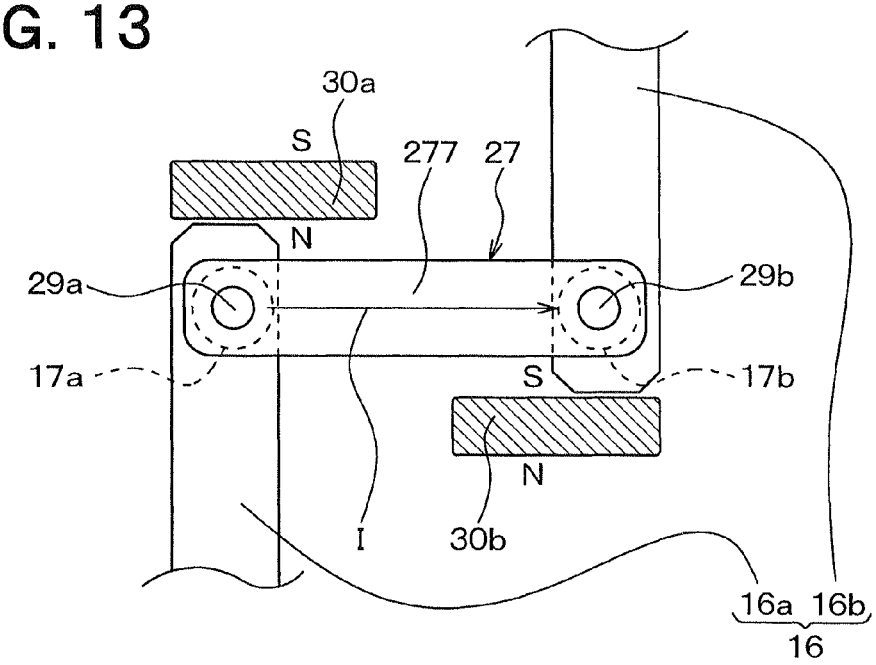
FIG. 13 is a schematic diagram showing fixed contact retainers, a movable element and permanent magnets of an electromagnetic relay according to a seventh embodiment of the present invention.

Next, a seventh embodiment of the present invention will be explained. FIG. 13 is a schematic diagram showing the fixed contact retainers, the movable element and the permanent magnets of the electromagnetic relay according to the seventh embodiment. The arrangement of the fixed contact retainers and the permanent magnets according to the present embodiment is modified from that of the electromagnetic relay according to the fifth embodiment. The other construction is the same. Therefore, only differences from the fifth embodiment will be explained in the following description.

As shown in FIG. 13, the electromagnetic relay according to the present embodiment is constructed such that the load circuit terminal (not shown) of the first fixed contact retainer 16*a* and the load circuit terminal (not shown) of the second fixed contact retainer 16*b* protrude to an outside at the diagonal positions of the base 11 (refer to FIG. 8).

The first permanent magnet 30*a* extends to the lateral side of the first movable contact 29*a*. Accordingly, a Lorentz force is applied to an arc generated when the first movable contact 29*a* separates from the first fixed contact 17*a* whereby the Lorentz force extends and cuts off the arc.

The second permanent magnet 30*b* extends to the lateral side of the second movable contact 29*b*. Accordingly, a Lorentz force is applied to an arc generated when the second movable contact 29*b* separates from the second fixed contact 17*b*, whereby the Lorentz force extends and cuts off the arc.

Thus, in the electromagnetic relay according to the present embodiment, the separation between the movable contacts 29*a*, 29*b* and the fixed contacts 17*a*, 17*b* due to the electromagnetic repulsive force can be inhibited, and the arcs can be cut off.

Modifications

In the first and second embodiments, the third fixed contact 17*c* and the third movable contact 29*c* may be eliminated.

In each of the above-described embodiments, the fixed contacts 17*a*-17*c* constructed of the members different from the fixed contact retainers 16 are caulked and fixed to the fixed contact retainers 16. Alternatively, protrusions protruding toward the movable element 27 side may be formed on the fixed contact retainers 16 by pressing process and the protrusions may be used as the fixed contacts.

In each of the above-described embodiments, the movable contacts 29*a*-29*c* constructed of the members different from the movable element 27 are caulked and fixed to the movable element 27. Alternatively, protrusions protruding toward the fixed contact retainers 16 may be formed on the movable element 27 by pressing process, and the protrusions may be used as the movable contacts.

The above-described embodiments may be combined with each other arbitrarily as long as the combination is feasible.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An electromagnetic relay comprising:

a coil for generating an electromagnetic force when energized;

a movable member capable of being attracted by the electromagnetic force of the coil;

two fixed contact retainers having fixed contacts;

a plate-like movable element having a first movable contact and a second movable contact capable of contacting the fixed contacts and separating from the fixed contacts;

a contact pressure spring for biasing the movable element in a direction for bringing the fixed contacts and the first and second movable contacts into contact with each other;

a first magnet arranged near the first movable contact to be lateral to an outer periphery of the movable element; and a second magnet arranged near the second movable contact to be lateral to the outer periphery of the movable element, wherein when the movable member is attracted by the electromagnetic force of the coil, the movable member moves in a direction for separating from the movable element and the fixed contacts contact the first movable contact and the second movable contact because the contact pressure spring biases the movable element, the first magnet and the second magnet are arranged such that a line connecting a north pole and a south pole of the first magnet is parallel to a line connecting a north pole and a south pole of the second magnet and such that the first magnet and the second magnet are spaced from each other in a direction of the line connecting the north pole and the south pole of the first magnet, the first movable contact and the second movable contact are arranged between the first magnet and the second magnet and spaced from each other in the direction of the line connecting the north pole and the south pole of the first magnet, when a direction, which is perpendicular to both of the line, connecting the north pole and the south pole of the first magnet and a movement direction of the movable element, is defined as a reference direction a part of length of the movable element, which is measured along a line passing through the first movable contact in the reference direction, on a first side of the first movable contact is differentiated from another part of the length of the movable element, which is measured along the line passing through the first movable contact in the reference direction, on a second side of the first movable contact opposite to the first side such that a resultant force of Lorentz forces acting on the movable element near the first movable contact is directed in a direction for bringing the fixed contact and the first movable contact into contact with each other, and a part of length of the movable element, which is measured along a line passing through the second movable contact in the reference direction, on a first side of the second movable contact is differentiated from another part of the length of the movable element, which is measured along the line passing through the second movable contact in the reference direction, on a second side of the second movable contact opposite to the first side such that a resultant force of Lorentz forces acting on the movable element near the second movable contact is directed in a direction for bringing the fixed contact and the second movable contact into contact with each other.

2. The electromagnetic relay as in claim 1, wherein the movable element has a first magnet-side plate portion that is close to the first magnet and that extends in the reference direction, a second magnet-side plate portion that is close to the second magnet and that extends in the reference direction, and a connecting plate portion that is inclined with respect to the reference direction and that connects an end portion of the first magnet-side plate portion on a first end side with respect to the reference direction and an end portion of the second magnet-side plate portion on a second end side with respect to the reference direction opposite to the first end side, the movable element is formed in a Z-shape when viewed along the movement direction of the movable element, the first movable contact is arranged in an end portion of the first magnet-side plate portion on the second end side with respect to the reference direction, the second movable contact is arranged in an end portion of the second magnet-side plate portion on the first end side with respect to the reference direction, the first magnet has a north pole positioned on the movable element side, and the second magnet has a south pole positioned on the movable element side.

3. The electromagnetic relay as in claim 1, wherein the movable element has a first magnet-side plate portion that is close to the first magnet and that extends in the reference direction, a second magnet-side plate portion that is close to the second magnet and that extends in the reference direction, and a connecting plate portion that is perpendicular to the reference direction and that connects an end portion of the first magnet-side plate portion on a first end side with respect to the reference direction and an end portion of the second magnet-side plate portion on the first end side with respect to the reference direction, the movable element is formed in a U-shape having angled corners when viewed along the movement direction of the movable element, the first movable contact is arranged in an end portion of the first magnet-side plate portion on a second end side with respect to the reference direction opposite to the first end side, the second movable contact is arranged in an end portion of the second magnet-side plate portion on the second end side with respect to the reference direction, the first magnet has a north pole positioned on the movable element side, and the second magnet has a north pole positioned on the movable element side.

* * * * *